US011162322B2

(12) United States Patent
Dockweiler et al.

(10) Patent No.: US 11,162,322 B2
(45) Date of Patent: Nov. 2, 2021

(54) WELLBORE ISOLATION DEVICE

(71) Applicant: HALLIBURTON ENERGY SERVICES, INC., Houston, TX (US)

(72) Inventors: David Allen Dockweiler, Prosper, TX (US); Tyler Joseph Norman, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 307 days.

(21) Appl. No.: 16/332,540

(22) PCT Filed: Apr. 5, 2018

(86) PCT No.: PCT/US2018/026309
§ 371 (c)(1),
(2) Date: Mar. 12, 2019

(87) PCT Pub. No.: WO2019/194813
PCT Pub. Date: Oct. 10, 2019

(65) Prior Publication Data

US 2021/0140263 A1 May 13, 2021

(51) Int. Cl.
*E21B 33/128* (2006.01)
*E21B 33/134* (2006.01)
(Continued)

(52) U.S. Cl.
CPC ..... *E21B 33/128* (2013.01); *E21B 33/134* (2013.01); *E21B 43/103* (2013.01);
(Continued)

(58) Field of Classification Search
CPC ..... E21B 33/128; E21B 33/134; E21B 43/103
See application file for complete search history.

(56) References Cited

U.S. PATENT DOCUMENTS 5,220,959 A 6/1993 Vance, Sr.
6,276,690 B1 8/2001 Gazewood
(Continued)

FOREIGN PATENT DOCUMENTS

WO 2014100072 A1 6/2014
WO 2016036371 A1 3/2016
(Continued)

OTHER PUBLICATIONS

Frac Plugs; Maverick Downhole Technologies Inc.; retrieved from http://www.maverick-tec.com/store/c6/FRAC_PLUGS.html on Apr. 5, 2018.

(Continued)

*Primary Examiner* — D. Andrews
(74) *Attorney, Agent, or Firm* — Polsinelli PC

(57) ABSTRACT

A wellbore isolation device is provided which includes a tubular body having an external surface and an inner bore formed longitudinally through the tubular body. The tubular body has an expanding section transitionable from an initial configuration to an expanded configuration. One or more fins project radially from the external surface of the expanding section. The fins are anchorable into surrounding surfaces when the expanding section transitions to the expanded configuration. A plugging element is positioned, after the expanding section is in the expanded configuration, to restrict fluid communication through the inner bore.

23 Claims, 10 Drawing Sheets

(51) Int. Cl.

| | |
|---|---|
| ***E21B 43/10*** | (2006.01) |
| *E21B 33/124* | (2006.01) |
| *E21B 33/127* | (2006.01) |

(52) U.S. Cl.
CPC ..... *E21B 43/105* (2013.01); *E21B 33/124* (2013.01); *E21B 33/127* (2013.01)

(56) References Cited

U.S. PATENT DOCUMENTS

| | | | | |
|---|---|---|---|---|
| 7,048,066 | B2 | 5/2006 | Ringgenberg et al. | |
| 9,045,963 | B2 | 6/2015 | Shkurti et al. | |
| 9,062,522 | B2 | 6/2015 | Frazier | |
| 9,169,704 | B2 | 10/2015 | Dockweiler et al. | |
| 9,316,085 | B2 | 4/2016 | Fuglestad | |
| 9,506,322 | B2 | 11/2016 | Prosser et al. | |
| 9,556,704 | B2 | 1/2017 | Naedler et al. | |
| 10,184,307 | B2 * | 1/2019 | Bar | E21B 43/26 |
| 2007/0039161 | A1 * | 2/2007 | Garcia | E21B 43/106 29/507 |
| 2010/0314130 | A1 | 12/2010 | Durst et al. | |
| 2011/0005778 | A1 | 1/2011 | Foster et al. | |
| 2012/0255723 | A1 | 10/2012 | Standridge | |
| 2014/0145402 | A1 | 5/2014 | Hallundbaek et al. | |
| 2014/0174763 | A1 | 6/2014 | Zhong et al. | |
| 2015/0129215 | A1 * | 5/2015 | Xu | E21B 33/12 166/285 |
| 2015/0376978 | A1 | 12/2015 | Hiorth | |
| 2016/0010426 | A1 | 1/2016 | Love | |
| 2016/0108695 | A1 | 4/2016 | Okura et al. | |
| 2016/0265303 | A1 | 9/2016 | Dockweiler | |
| 2016/0305215 | A1 | 10/2016 | Harris et al. | |
| 2017/0022781 | A1 * | 1/2017 | Martin | E21B 33/1208 |
| 2017/0241231 | A1 * | 8/2017 | Benzie | E21B 33/1208 |

FOREIGN PATENT DOCUMENTS

| | | | |
|---|---|---|---|
| WO | 2016065291 | A1 | 4/2016 |
| WO | 2016186643 | A1 | 11/2016 |

OTHER PUBLICATIONS

International Search Report and Written Opinion; PCT Application No. PCT/US2018/026309; dated Jan. 2, 2019.

* cited by examiner

WELLBORE ISOLATION DEVICE

CROSS-REFERENCE TO RELATED APPLICATIONS

This application is a national stage entry of PCT/US2018/026309 filed Apr. 5, 2018, said application is expressly incorporated herein in its entirety.

FIELD

The present disclosure relates generally to downhole tools used to isolate portions of a subterranean wellbore.

BACKGROUND

Wellbores are drilled into the earth for a variety of purposes including accessing hydrocarbon bearing formations. A variety of downhole tools may be used within a wellbore in connection with accessing and extracting such hydrocarbons. Throughout the process, it may become necessary to isolate or seal one or more portions of a wellbore. Zonal isolation within a wellbore may be provided by wellbore isolation devices, such as packers, bridge plugs, and fracturing plugs (i.e., "frac" plugs). For example, a wellbore isolation device can be used to isolate the target zone for the hydraulic fracturing operation by forming a pressure seal in the wellbore that prevents the high pressure fracturing fluid from extending downhole of the wellbore isolation device.

BRIEF DESCRIPTION OF THE DRAWINGS

Implementations of the present technology will now be described, by way of example only, with reference to the attached figures, wherein.

DETAILED DESCRIPTION

Figure 1:
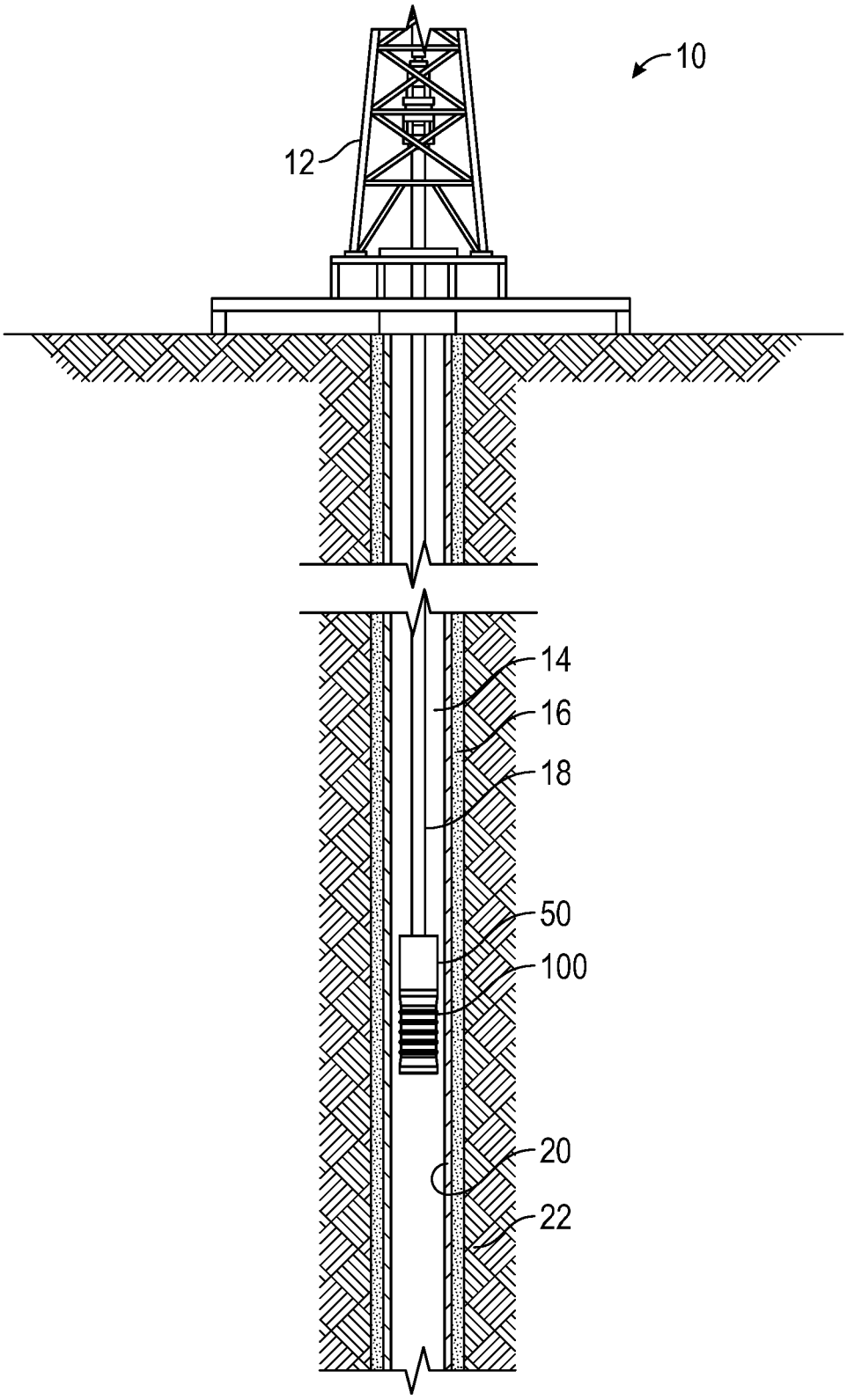
FIG. 1 is a diagram illustrating an exemplary environment for a wellbore isolation device according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "substantially" is defined to be essentially conforming to the particular dimension, shape or other word that substantially modifies, such that the component need not be exact.

Disclosed herein is a wellbore isolation device for providing zonal isolation in a wellbore and which equalizes pressure differentials downhole prior to retrieval. The wellbore isolation device can be deployed in a wellbore to a desired location. The wellbore isolation device has a tubular body having an external surface and an inner bore formed longitudinally through the tubular body. The tubular body includes an expanding section. The expanding section is transitionable between an initial configuration to an expanded configuration, where the external surface along the expanding section increases in diameter from the initial configuration to the expanded configuration. The wellbore isolation device also includes one or more fins projecting radially from the external surface of the expanding section. As such, when the expanding section transitions to the expanded configuration, the fins anchor into surrounding surfaces, such as casing or formation, and can create a seal. Also, the wellbore isolation device includes a plugging element, such as a ball, which can be positioned at an end of the tubular body to restrict fluid communication through the inner bore. Accordingly, the wellbore isolation device is able to anchor into any location in the wellbore, providing zonal isolation at any position in the wellbore without any receptacle.

The wellbore isolation device can be employed in an exemplary wellbore system 10 shown, for example, in FIG. 1. A system 10 for anchoring a downhole tool in a wellbore includes a drilling rig 12 extending over and around a wellbore 14. The wellbore 14 is within an earth formation 22 and has a casing 20 lining the wellbore 14, the casing 20 is held into place by cement 16. A wellbore isolation device 100 can be moved down the wellbore 14 via a conveyance 18 to a desired location. A conveyance can be, for example, tubing-conveyed, wireline, slickline, work string, coiled tubing, or any other suitable means for conveying downhole tools into a wellbore. Once the wellbore isolation device 100 reaches the desired location a downhole tool 50 may be actuated to deploy the wellbore isolation device 100.

It should be noted that while FIG. 1 generally depicts a land-based operation, those skilled in the art would readily recognize that the principles described herein are equally applicable to operations that employ floating or sea-based platforms and rigs, without departing from the scope of the disclosure. Also, even though FIG. 1 depicts a vertical wellbore, the present disclosure is equally well-suited for use in wellbores having other orientations, including horizontal wellbores, slanted wellbores, multilateral wellbores or the like. Further, the wellbore system 10 can have a casing already implemented while, in other examples, the system 10 can also be used in open hole applications.

Figure 2:
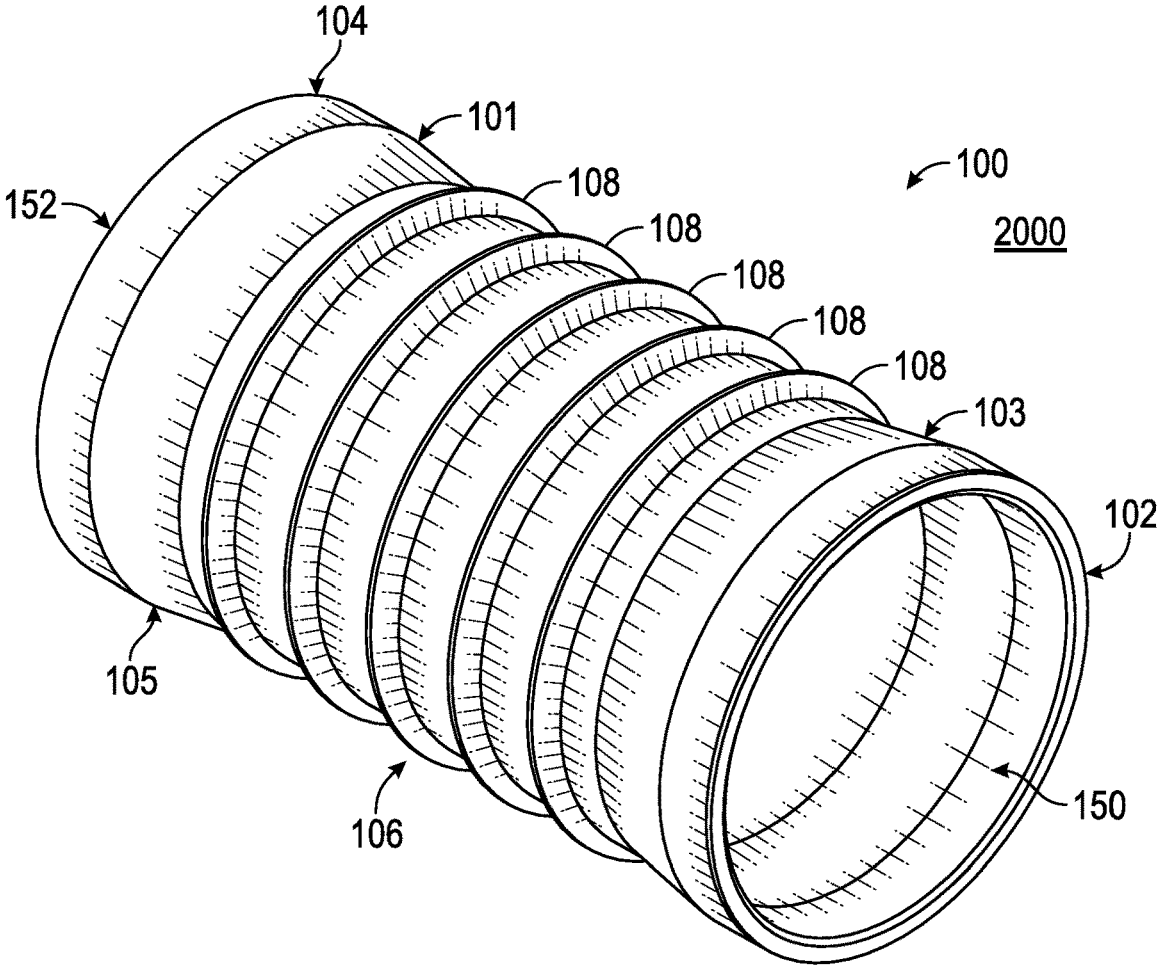
FIG. 2 is a diagram illustrating a perspective view of one example of a wellbore isolation device with an expanding section in an initial configuration.

FIG. 2 illustrates a schematic diagram of a wellbore isolation device 100 in an initial configuration 2000. The wellbore isolation device 100 includes a tubular body 101. The tubular body 101 has an inner bore 154 (shown in FIG. 4) formed longitudinally or transversely through the tubular body 101. The tubular body 101 includes a first opening 150 and a second opening 152 which provide access to the inner bore 154. The tubular body 101 has an expanding section 106. The tubular body 101, as illustrated in FIG. 2, also has a first wide section 102, which corresponds with the first opening 150, a second wide section 104 which corresponds with the second opening 152, a first transition section 103 between the first wide section 103 and the expanding section 106, and a second transition section 105 between the second wide section 104 and the expanding section 105. In at least one example, the tubular body 101 does not include at least one of the first and the second wide sections 102, 104. Also, in at least one example, the tubular body 101 may not have the first and/or the second transition sections 103, 105.

Figure 3:
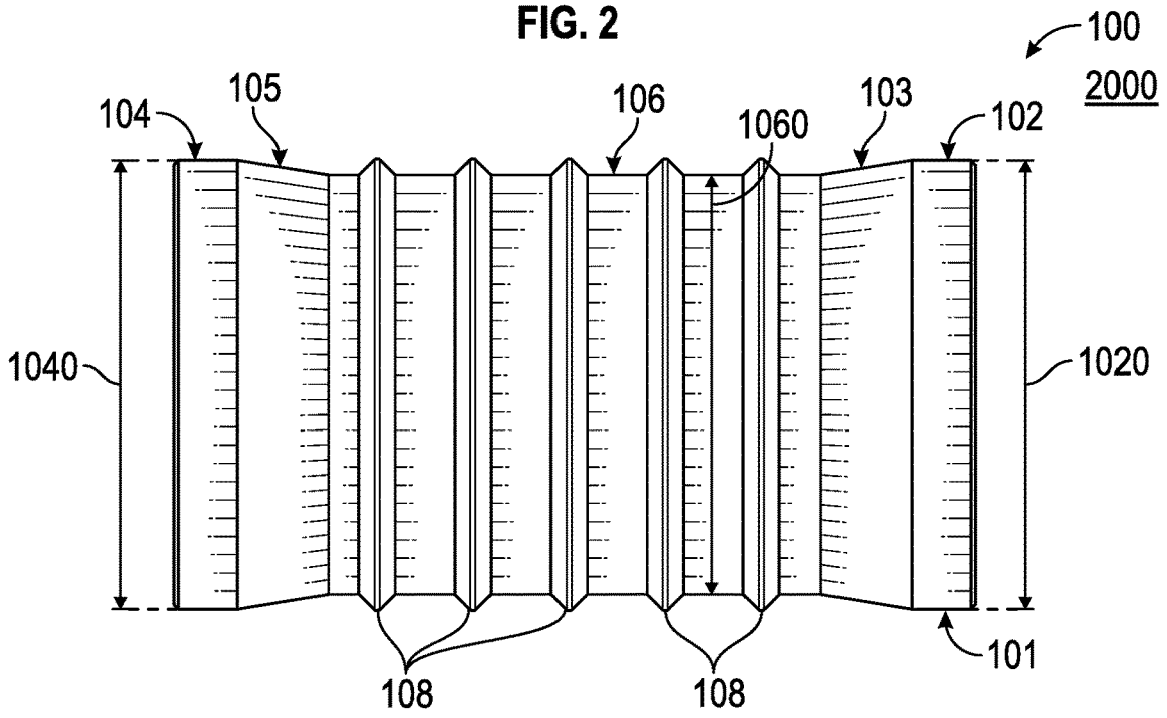
FIG. 3 is a side elevational view of the wellbore isolation device of FIG. 2.
Figure 4:
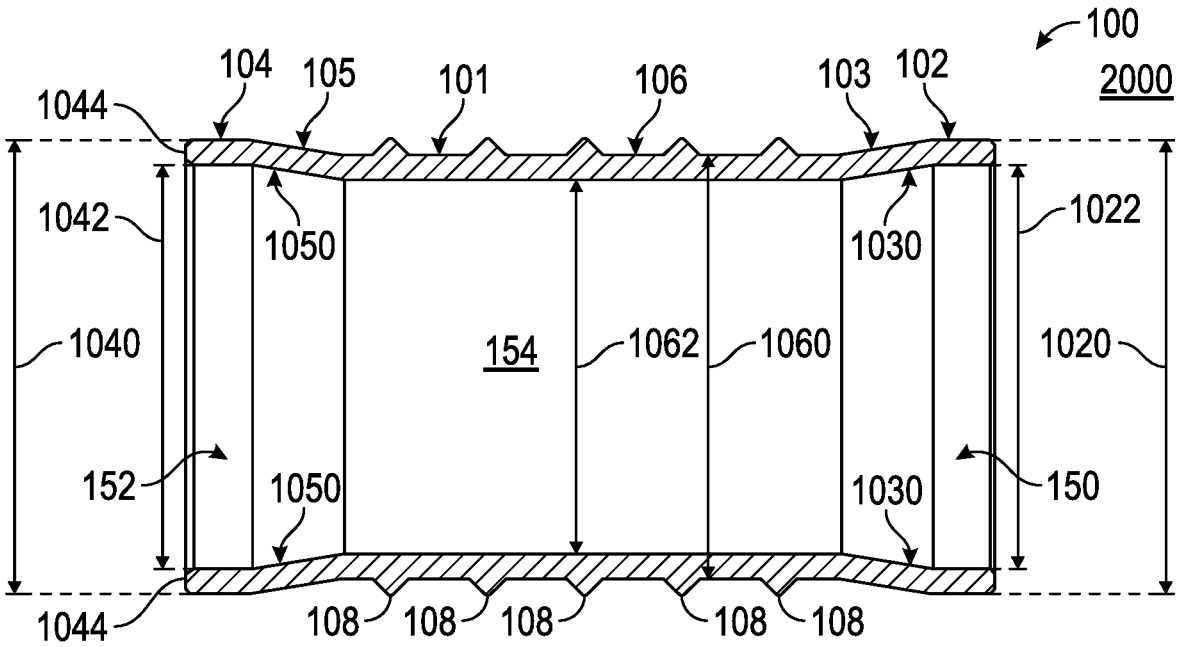
FIG. 4 is a cross-sectional view of the wellbore isolation device of FIG. 2.

FIG. 3 is a schematic diagram illustrating respective dimensions of the well isolation device 100 in initial configuration 2000. As illustrated the first and second wide sections 102, 104 have a first wide external diameter 1020 and a second wide external diameter 1040, respectively. The first and second wide external diameters 1020, 1040 are measured between opposing external surfaces of the first and second wide sections 102, 104. The first wide external diameter 1020 and the second wide external diameter 1040 may have the same diameter. In other examples, the first wide external diameter 1020 and the second wide external diameter 1040 may have different diameters. In the initial configuration, the first wide external diameter 1020 can be greater than an expanding external diameter 1060, and the second wide external diameter 1040 can be greater than an expanding external diameter 1060. The expanding external diameter 1060 is measured between opposing external surfaces of the expanding section 106. The first and second transition sections 103, 105 transition the tubular body 101 from the first and second wide sections 102, 104 to the expanding section 106. The first and second transition sections 103, 105, as illustrated in FIGS. 2-4, are substantially linear. In other examples, the first and/or the second transition sections 103, 105 can be curved, for example having a concave curve. The widest section of the tubular body 101 is small enough to fit within the wellbore and to be transported to any desired section of the wellbore. For example, to pass through a wellbore casing, the diameter of the tubular body 101 may be about 4.5 inches to about 5.5 inches. The size of the wellbore isolation device 100 can vary as desired.

FIG. 4 is a schematic diagram illustrating further dimensions of the well isolation device 100 in initial configuration 2000. As shown in FIG. 4, the first wide section 102 has a first wide internal diameter 1022 which is measured between opposing surfaces of inner bore 154 of the first wide section 102. The second wide section 104 has a second wide internal diameter 1042 which is measured between opposing surfaces of inner bore 154 of the second wide section 104. Similarly, the expanding section 106 has an expanding internal diameter 1062 which is measured between opposing surfaces of the inner bore 154 of the expanding section 106. In the initial configuration 2000, the expanding internal diameter 1062 can be less than the first and/or the second wide internal diameters 1022, 1042. The difference between the first and second wide internal diameters 1022, 1042 and the expanding internal diameter 1062, and the first and second wide external diameters 1020, 1040 and the expanding external diameter 1060 is a thickness of the tubular body 101. In at least one example, the thickness of the tubular body 101 may be uniform throughout the tubular body 101. In other examples, the thickness of the tubular body 101 may differ between each section to reinforce the strength of the tubular body 101 or to provide greater ability to deform, for example, at the expanding section 106. The first and second transition sections 103, 105 have internal transition surfaces 1030, 1050 which transition between the first and second wide internal diameters 1022, 1042 and the expanding internal diameter 1062. The internal transition surfaces 1030, 1050 can be substantially linear. In at least one example, the internal transition surfaces 1030, 1050 are curved, for example curves which convex toward the inner bore 154.

The tubular body 101 has substantially a cylindrical shape. While the examples of the tubular body 101 provided in this disclosure show the tubular body 101 being substantially cylindrical, the tubular body 101 and/or any of the expanding section 106, the first and second wide sections 102, 104, and the first and second transition sections 103, 105 can be any suitable shape such as rectangular, ovoid, or triangular. The tubular body 101 can be made of a deformable material, for example, cast iron or any other suitable material which is deformable such that the expanding section 106 can be deformed and maintain its shape and has also strength to resist the pressures and forces within the wellbore. In at least one example, the material of the tubular body 101 may be dissolvable or degradable such that the wellbore isolation device 100 is temporarily deployed for a desired amount of time. In other examples, the material of the tubular body 101 can be a material which does not dissolve or degrade such that the wellbore isolation device can be permanently deployed. The material of the first and second wide sections 102, 104, the first and second transition sections 103, 105, and the expanding section 106 can be the same. The tubular body 101 can be one single piece design, lowering the cost and complexity of manufacturing the wellbore isolation device 100. In other examples, the material of the expanding section 106 can be different than the material of the first and second wide sections 102, 104 and/or the first and second transition sections 103, 105.

Projecting radially from the external surface of the expanding section 106 are one or more fins 108. As illustrated in FIGS. 2-4, the wellbore isolation device 100 includes five fins 108. In at least one example, the wellbore isolation device 100 can include one, two, three, four, or more than five fins 108. The fins 108 as illustrated in FIGS. 2-4 are spaced equidistance from one another across the expanding section 106. In at least one example, the fins 108 are spaced in other configurations as desired, for example where the fins 108 are not spaced equally across the expanding section 106.

As illustrated in FIGS. 2-4, the one or more fins 108 traverse substantially an entire circumference of the tubular body 101. As such, the one or more fins 108, when anchored into the surrounding surfaces, create a seal, preventing fluid communication across the fins 108.

The fins 108 can be the same material as the tubular body 101. In the example illustrated in FIGS. 2-4, the fins 108 and the tubular body 101 may be one single piece design. In other examples, the fins 108 can be another material, for example, aluminum, steel, magnesium, cast iron, and a combination thereof, such that the fins 108 have sufficient hardness and is not brittle to anchor into the surrounding surfaces.

Figure 5A:
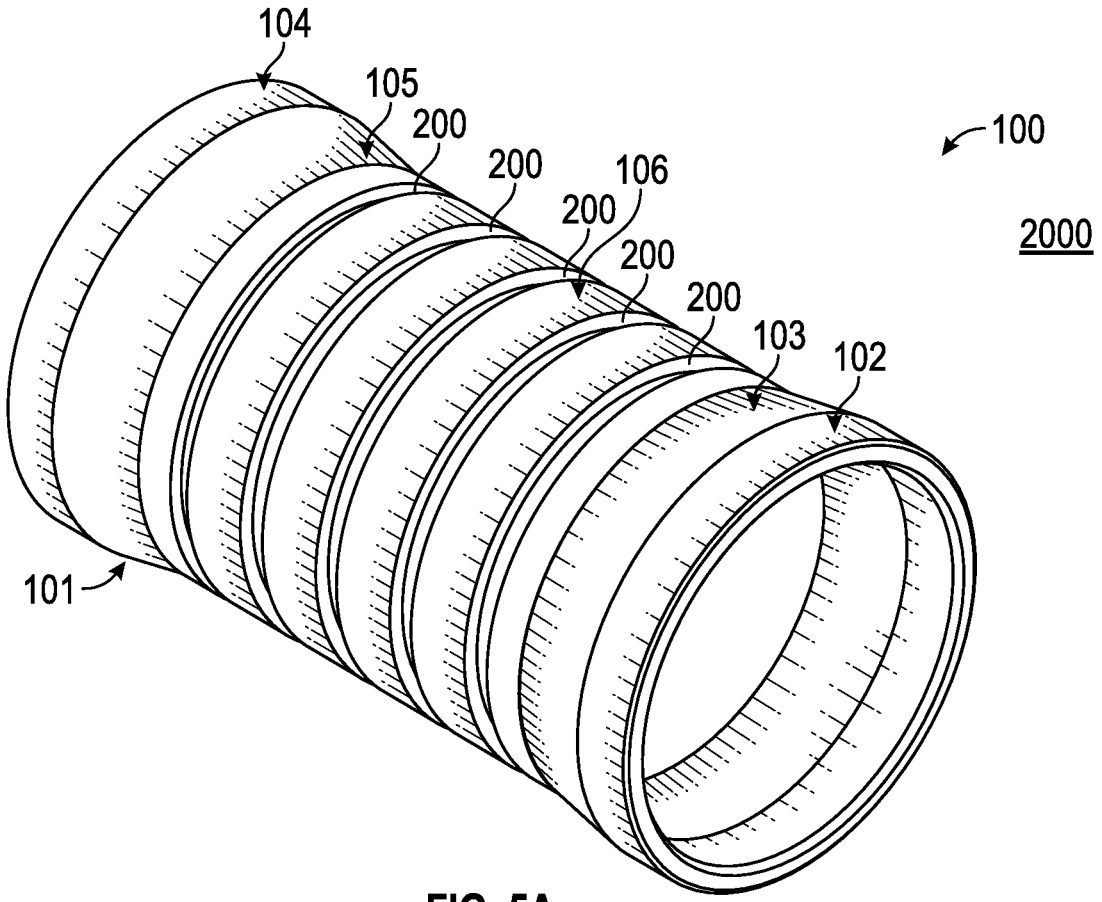
FIG. 5A is a diagram illustrating a perspective view of a tubular body of another example of a wellbore isolation device with an expanding section in an initial configuration.
Figure 5B:
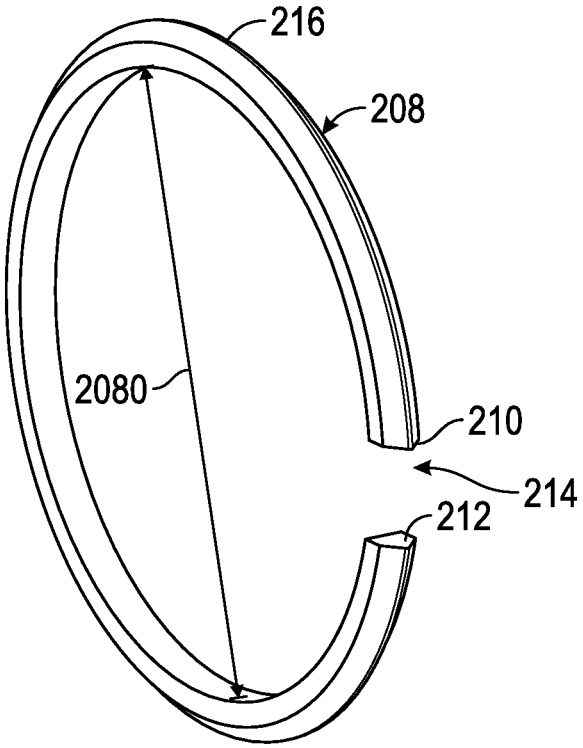
FIG. 5B is a diagram illustrating a perspective view of a split ring.

FIG. 5A is an embodiment of a tubular body 101 of a well isolation device 100 in initial configuration 2000 which includes grooves 200 configured to receive fins 208. FIG. 5B is a schematic diagrams of one or more fins 208 which can be coupled with the tubular body 101 of FIG. 5A. For example, the one or more fins 208 and the tubular body 101 are not one single piece. As illustrated in FIG. 5A, the expanding section 106 includes one or more grooves 200 corresponding with the size, shape, and number of fins 208. The one or more fins 208, as illustrated in FIG. 5B, can be split rings. In other examples, the fins 208 can initially be straight and bent around the tubular body 101.

The fins 208 can have a first end 210, a second end 212, and a space 214 between the first end 210 and the second end 212. The fins 208 can be substantially circular in shape. In other examples, the fins 208 can be any suitable shape that corresponds with the shape of the grooves 200 and/or the tubular body 101. The fins 208 have an inner diameter 2080 which is measured between opposing inner surfaces of the fins 208. The inner diameter 2080 of the fins 208 corresponds with the diameter of the grooves 200 in the expanding section 106. In at least one example, the tubular body 101 does not include grooves 200, and the inner diameter 2080 of the fins 208 corresponds with the expanding external diameter 1060 of the expanding section 106. The material of the fins 208 can be the same material as the tubular body 101. In other examples, the fins 208 can be another material, for example, aluminum, steel, magnesium, cast iron, and a combination thereof, such that the fins 208 have sufficient hardness and is not brittle to anchor into the surrounding surfaces. Additionally, the fins 208 are sufficiently deformable such that the fins 208 can expand with the expanding section 106 to the expanded configuration 3000.

To fit the fins 208 onto the grooves 200 and coupled with the tubular body 101, the fins 208 can be temporarily deformed. The space 214 is expanded until the fins 208 are able to surround the circumference of the tubular body 101. The fins 208 are then released and return substantially to its initial shape. The space 214 is substantially its initial size. As such, the fins 208 are coupled to the tubular body 101 by force fit. When the fins 208 are coupled with the tubular body 101, the fins 208 traverse substantially an entire circumference of the tubular body 101. The space 214 is minimal, such that the fins 208, when anchored into the surrounding surfaces, are able to create a seal and fluid communication is substantially only permitted through the inner bore 154 of the tubular body 101. In at least one example, the space 214 is filled with pumped material such as sand to fill the space 214.

In at least one example, the fins 208 are coupled to the tubular body 101 and/or the grooves 200 by any suitable method, for example adhesives, welding, or fasteners.

Figure 6:
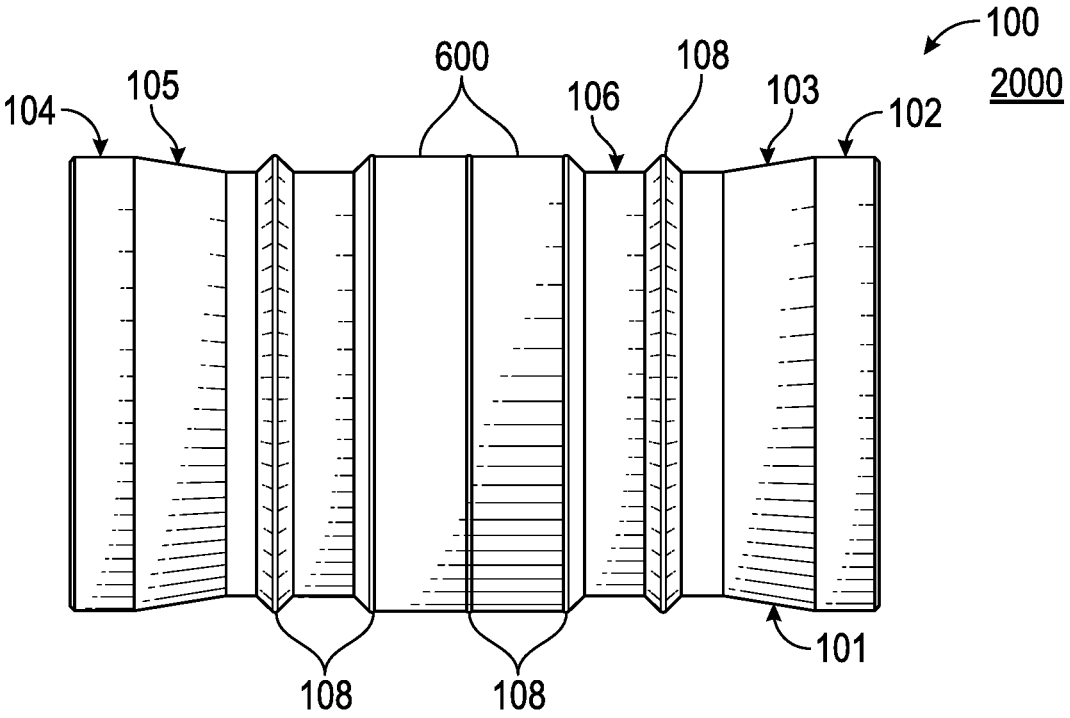
FIG. 6 is a side elevational view of the wellbore isolation device of FIG. 2 with a sealing element coupled therewith.
Figure 7:
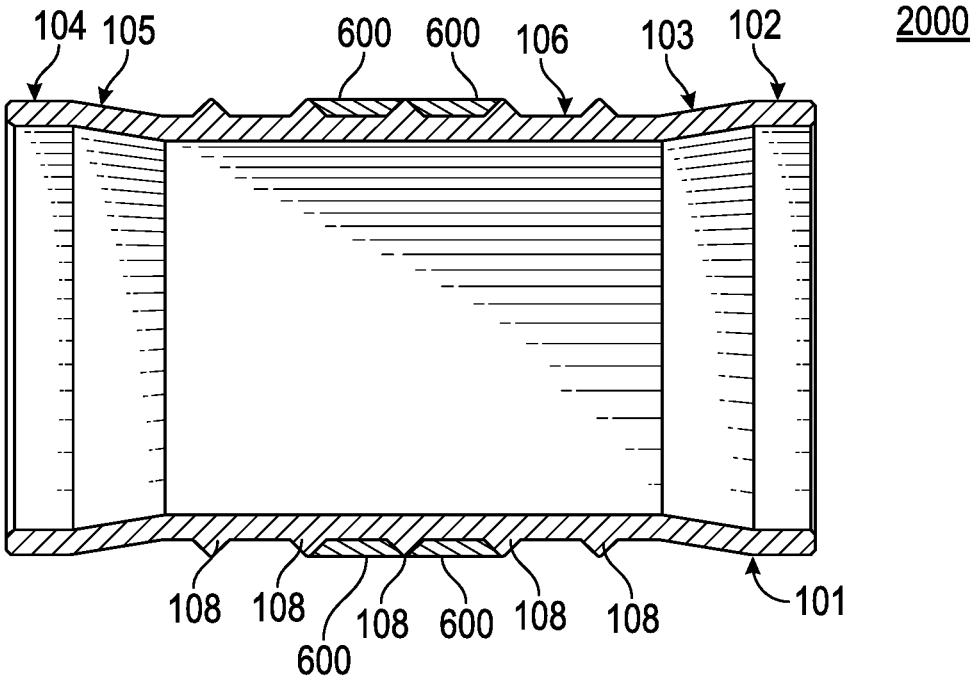
FIG. 7 is cross-sectional view of the wellbore isolation device of FIG. 6.
Figure 8:
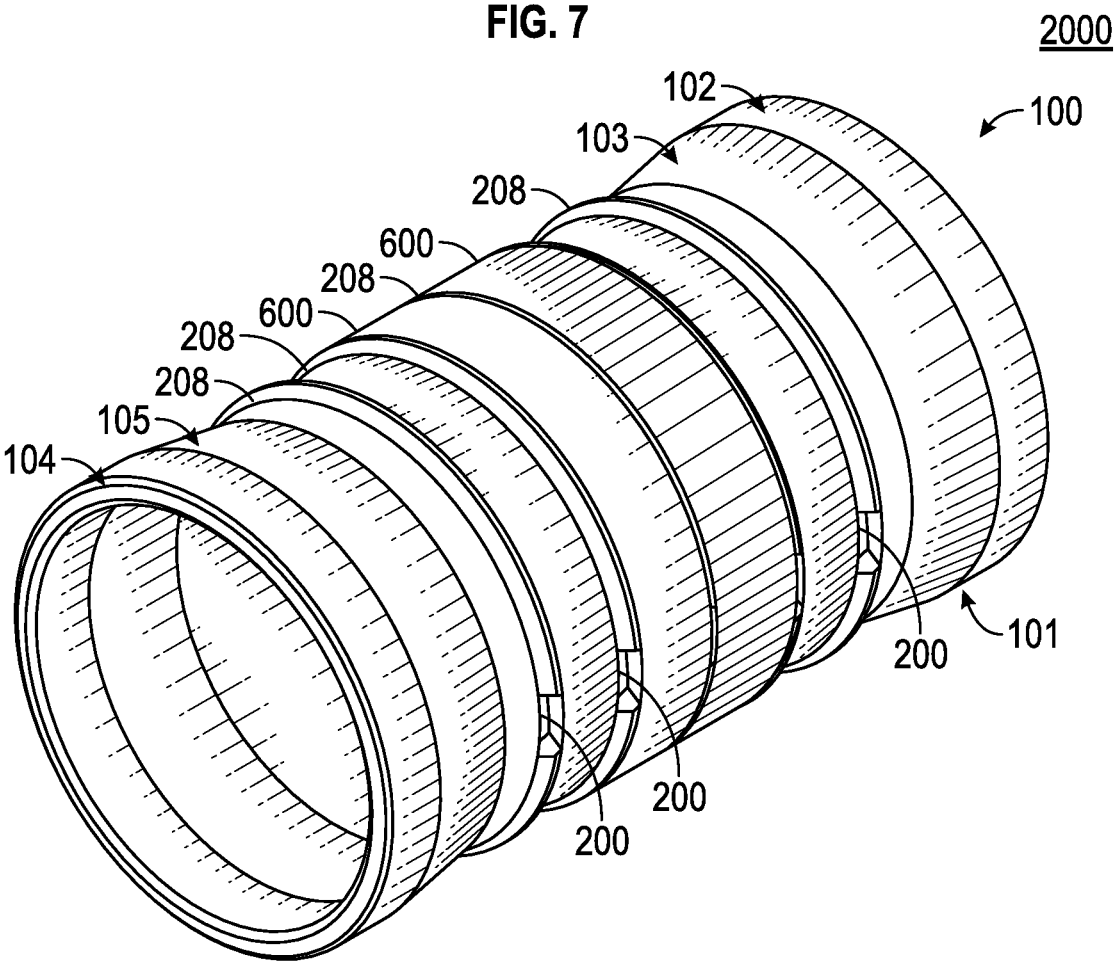
FIG. 8 is a diagram illustrating a tubular body of the wellbore isolation device of FIG. 5A with a sealing element coupled therewith.
Figure 9:
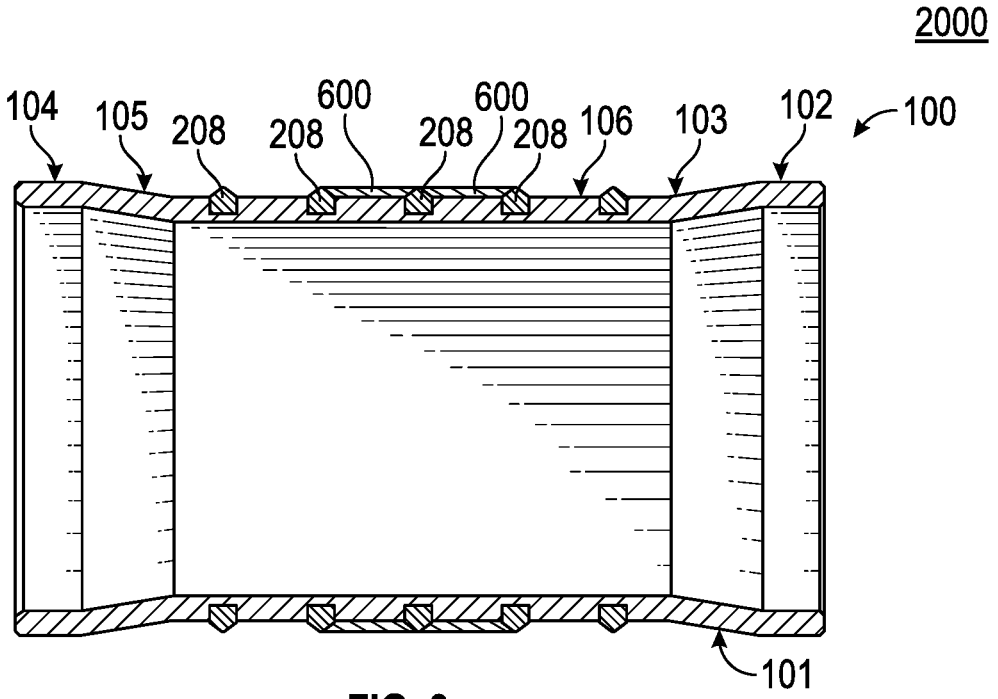
FIG. 9 is cross-sectional view of the wellbore isolation device of FIG. 8.

As illustrated in FIG. 6, a wellbore isolation device 100 where the fins 108 and the tubular body 101 are one piece can include one or more sealing elements 600. FIG. 7 illustrates a cross-sectional view of the wellbore isolation device 100 of FIG. 7. FIG. 8 illustrates a wellbore isolation device 100 where the fins 208 are split rings received in corresponding grooves 200 also having one or more sealing elements 600. FIG. 9 illustrates a cross-sectional view of the wellbore isolation device of FIG. 8. While FIGS. 6-9 illustrate two sealing elements 600 on adjacent sides of the central fin 108, 208, the wellbore isolation device 100 can include one, three, four, or more sealing elements 600 at any desired location on the tubular body 101. In other examples, the wellbore isolation device 100 does not include sealing elements 600.

The sealing elements 600 are coupled with the expanding section 106 of the tubular body 101 such that when the expanding section 106 transitions to the expanded configuration 3000, the sealing elements 600 abut the surrounding surfaces. As such, the sealing elements 600, along with the one or more fins 108, 208, provide a seal against the surrounding surfaces such that fluid communication across the tubular body 101 is at least reduced. The sealing elements 600 can be coupled with the tubular body 101 by any fastening method, for example, adhesives or fasteners such as screws or nails. The sealing elements 600 can be made of a sealing material, for example rubber, elastomeric material, polyurethane, dissolvable material, degradable material, or any other suitable material or combination of materials to create a seal when abutted against a surface. In at least one example, the sealing elements 600 can extend from the tubular body 101 further than the fins 108, 208 such that when the expanding section 106 transitions to the expanded configuration 3000, the sealing elements 600 can abut the surrounding surfaces, compress, and provide a seal. When the sealing elements 600 and/or the fins 108, 208 provide a seal, fluid communication is substantially only permitted through the inner bore 154 of the tubular body 101.

Figure 10A:
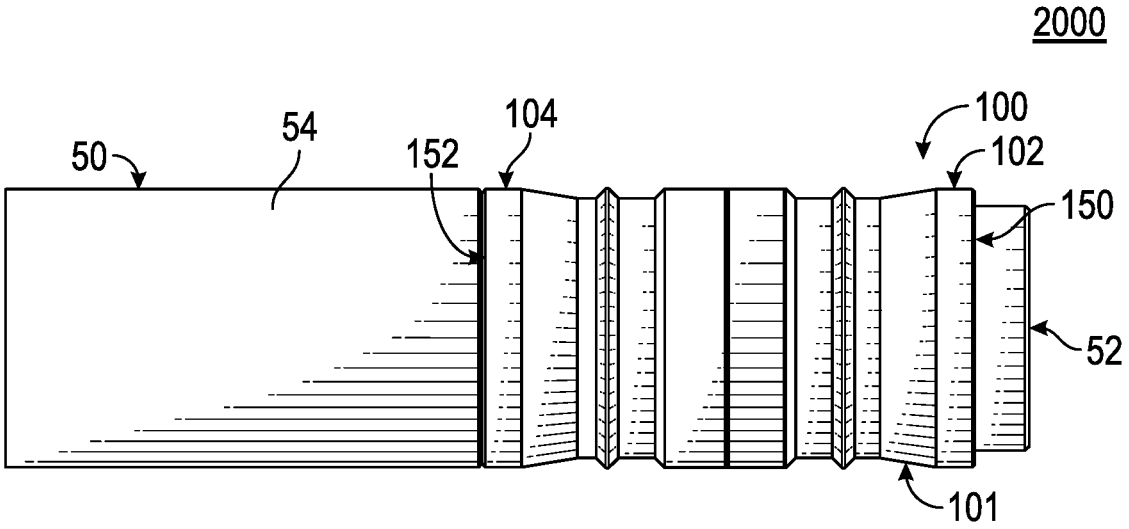
FIG. 10A is a diagram illustrating a wellbore isolation device coupled with a downhole tool.
Figure 10B:
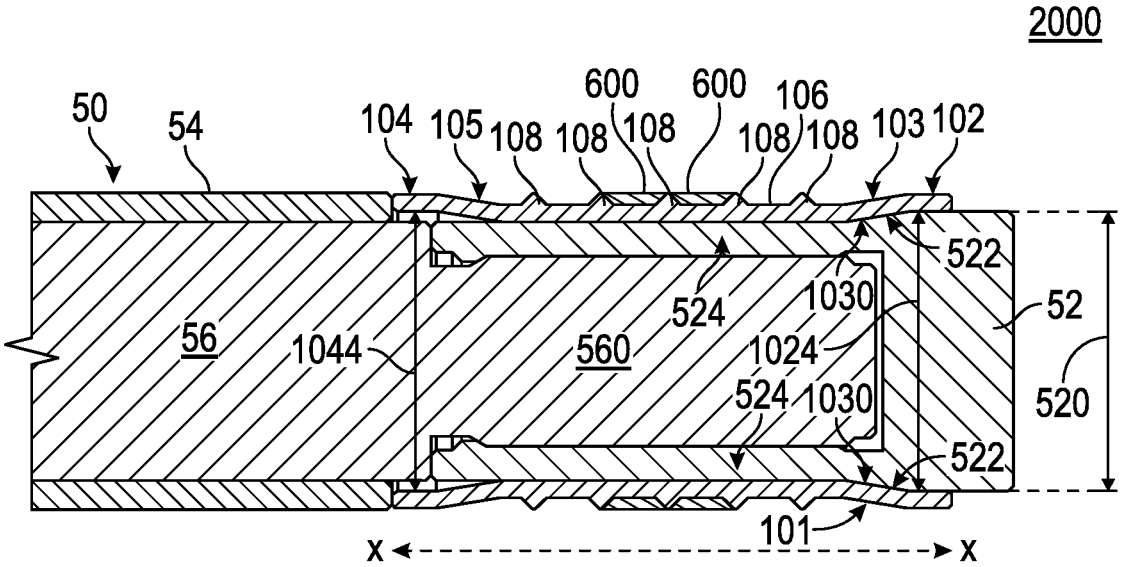
FIG. 10B is a cross-sectional view of FIG. 10A.

FIGS. 10A and 10B illustrates a schematic diagram of a downhole tool 50 which is coupled with a conveyance 18 (shown in FIG. 1) and is configured to transition the wellbore isolation device 100 from the initial configuration 2000 to the expanded configuration 3000. FIG. 10B illustrates a cross-sectional view of the downhole tool 500 and wellbore isolation device 100 of FIG. 10B. The downhole tool 50 transitions the expanding section from the initial configuration 2000 to the expanded configuration 3000 (shown in FIGS. 11-14). When positioned in a wellbore, the second wide section 104 is positioned uphole from the first wide section 102. The downhole tool 50 includes a setting sleeve 54 which abuts an outer edge 152 of the tubular body 101, which as illustrated in FIGS. 10A and 10B is the outer edge 152 of the second wide section 104. A mandrel 56 is positioned within the setting sleeve 54. The mandrel 56 has a coupling portion 560 which couples with an expansion cone 52. The expansion cone 52 is coupled with the coupling portion 560 by corresponding couplers 524. In at least one example, the coupling portion 560 and couplers 524 can be a threaded engagement or any other suitable engagement.

The expansion cone 52 is positioned within the inner bore 154 of the tubular body 101. The expansion cone 52 can have an expansion portion 522 which has an expansion diameter 520 which is greater than the expanding internal diameter 1062 when the expanding section 106 is in the initial configuration 2000. In at least one example, the expansion diameter 520 can be substantially equal to the first wide internal diameter 1024. The expansion cone 52 can also have an expansion transition section 522 which transitions the diameter of the expansion cone 52 from the expansion diameter 520 to a diameter which is equal to or less than the expanding internal diameter 1062 when the expanding section 106 is in the initial configuration 2000. In other examples, the expansion cone 52 only includes the expansion portion 522 with the expansion diameter 520 which is coupled with the mandrel 56.

To transition the expanding section 106 from the initial configuration 2000 to the expanded configuration 3000, the expansion cone 52 is moved along an axial direction X-X through the tubular body 101. In at least one example, the expansion cone 52 is moved uphole. The expansion cone 52 is moved from the first wide section 102 towards the second wide section 104. The wellbore isolation device 100 substantially maintains its position or moves downhole in a direction opposite the direction of the expansion cone 52. In at least one example, the setting sleeve 54 abuts the outer edge 152 of the tubular body 101 to counteract the movement of the mandrel 56 and/or the expansion cone 52. When moving along the axial direction X-X toward the second wide section 104, the expansion cone 52 abuts and deforms the inner surfaces 1030 of the first transition section 103. As the expansion cone 52 continues through the tubular body 101, the expansion cone 52 deforms and expands the expanding section 106 from the initial configuration 2000 to the expanded configuration 3000.

Figure 11:
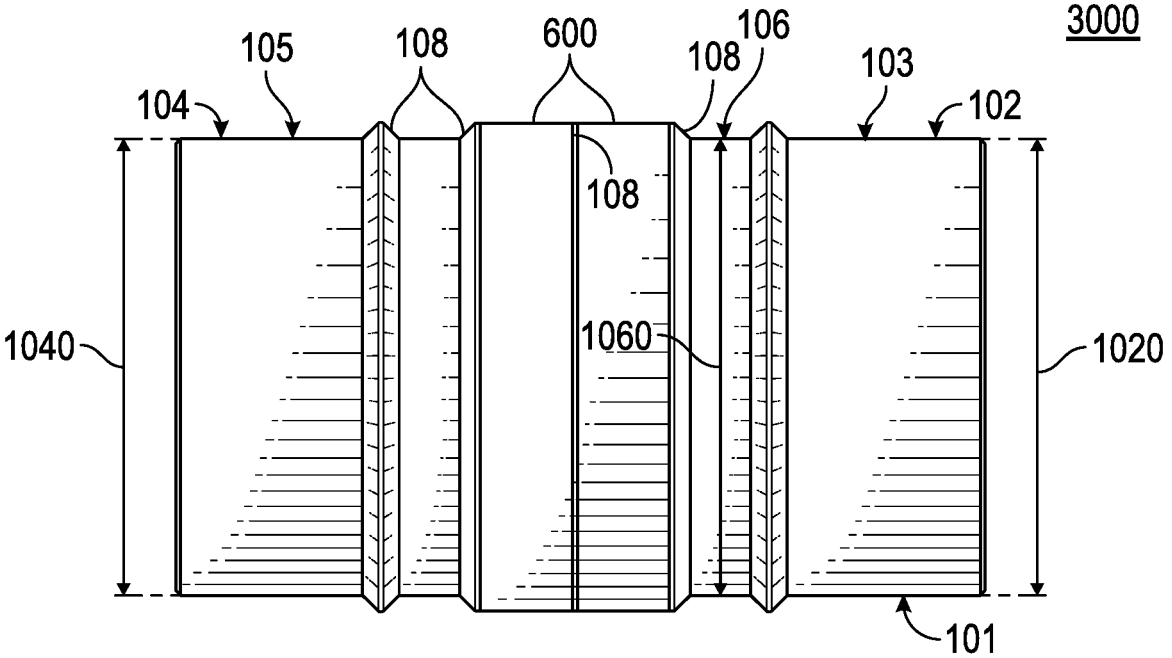
FIG. 11 is a diagram of the wellbore isolation device of FIG. 2 with an expanding section in an expanded configuration.
Figure 12:
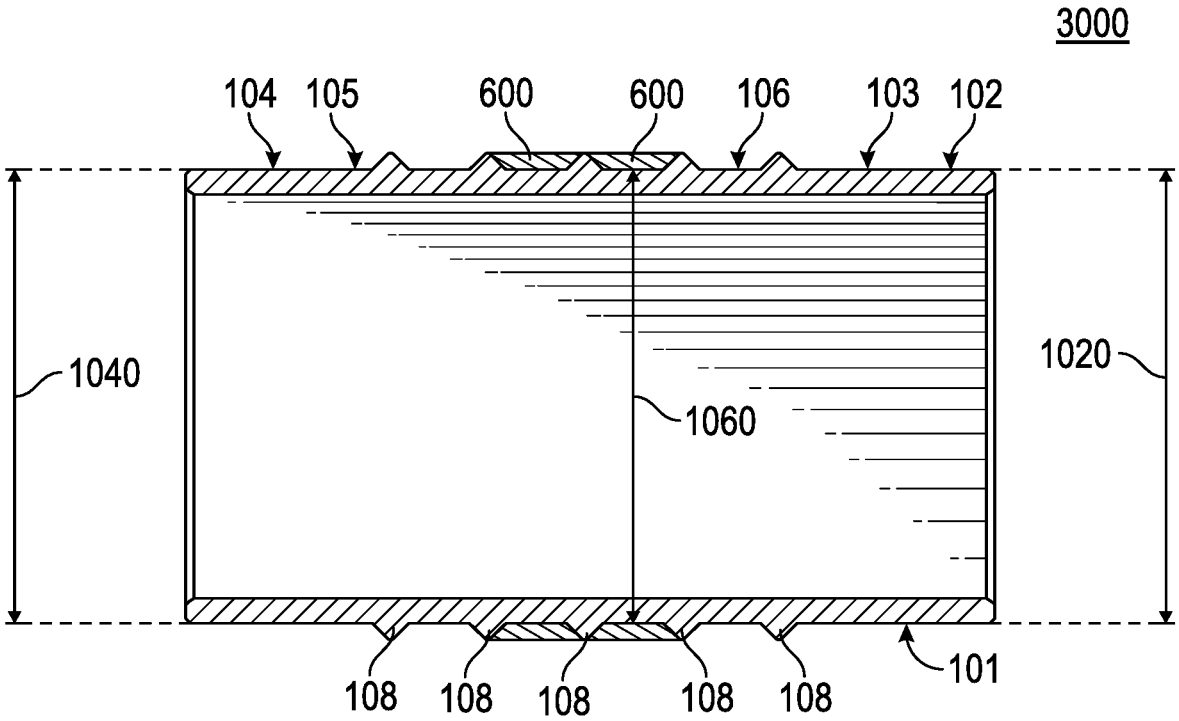
FIG. 12 is a cross-sectional view of FIG. 11.
Figure 13:
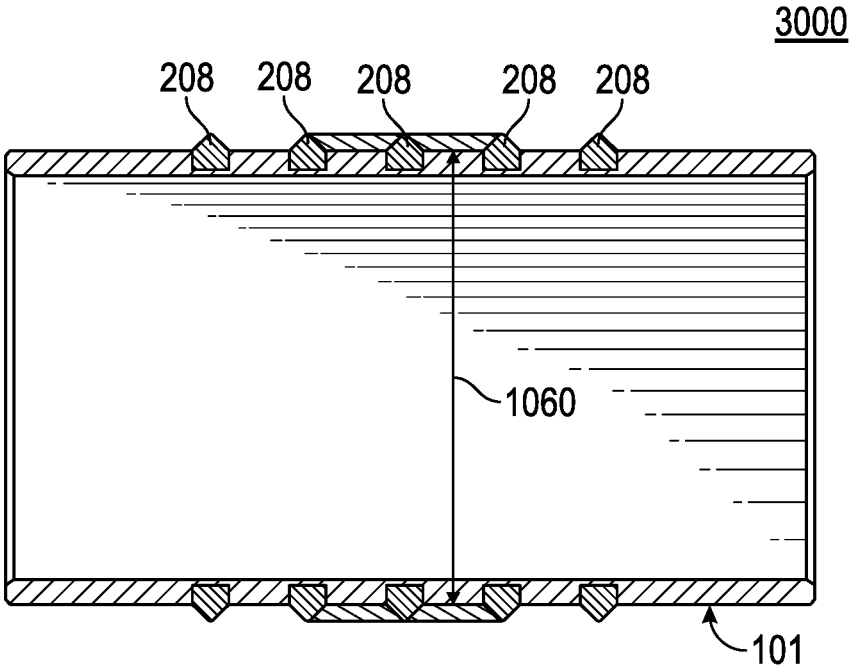
FIG. 13 is a cross-sectional view of the wellbore isolation device of FIG. 5A with an expanding section in an expanded configuration.

FIGS. 11-13 illustrate examples of the wellbore isolation device 100 with the expanding section 106 in the expanded configuration 3000. FIG. 11 illustrates a schematic diagram of an exemplary wellbore isolation device 100 where the one or more fins 108 and the tubular body 101 are one piece. FIG. 12 illustrates a cross-sectional view of the wellbore isolation device 100 of FIG. 11. FIG. 13 illustrates the exemplary wellbore isolation device 100 where the one or more fins 208 are coupled with the tubular body 101. In the expanded configuration 3000, the expanding external diameter 1060 is greater than when in the initial configuration 2000. In at least one example, the expanding external diameter 1060 in the expanded configuration 3000 can be substantially equal to the first and/or second external wide diameters 1020, 1040.

Figure 14:
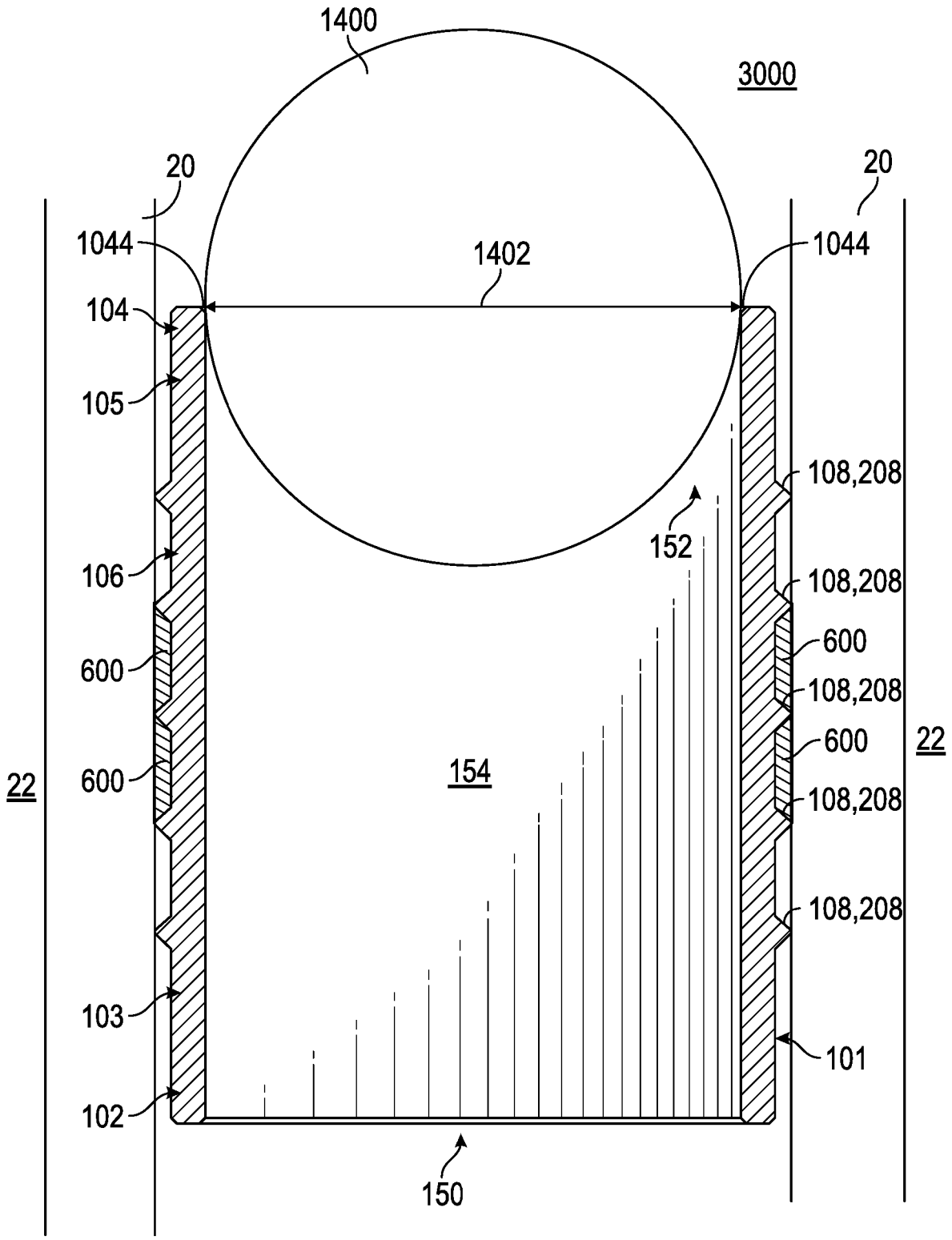
FIG. 14 is a cross-sectional view of a wellbore isolation device with a plugging element.

FIG. 14 illustrates a cross-sectional view of a wellbore isolation device 100 in the expanded configuration 3000 where one or more fins 108, 208 are anchored into surrounding surfaces at a predetermined location in a wellbore. In the expanded configuration 3000, as illustrated in FIG. 14, the one or more fins 108, 208 anchor into surrounding surfaces. For example, the fins 108, 208 can anchor into the casing 20. In other examples, the fins 108, 208 can anchor into the formation 22 of the wellbore or any other position within the wellbore. As such, the wellbore isolation device 100 does not require any fitted features to be positioned within the desired location. The fins 108, 208 and/or the sealing elements 600 can create a seal which reduces or substantially prevents fluid communication across the wellbore isolation device 100 and the surrounding surfaces. As such, fluid communication is provided substantially only through the inner bore 154.

To isolate sections within the wellbore, a plugging element 1400 can be positioned against the wellbore isolation device 100, creating a seal and preventing fluid communication through the inner bore 154. The plugging element 1400 can be positioned against the second wide section 104. In at least one example, the plugging element 1400 is a ball. In other examples, the plugging element 1400 can be any suitable shape or mechanism which prevents fluid communication through the inner bore 154. The plugging element 1400 can have a diameter 1402 which is substantially similar to or greater than the second wide internal diameter 1042.

Figure 15:
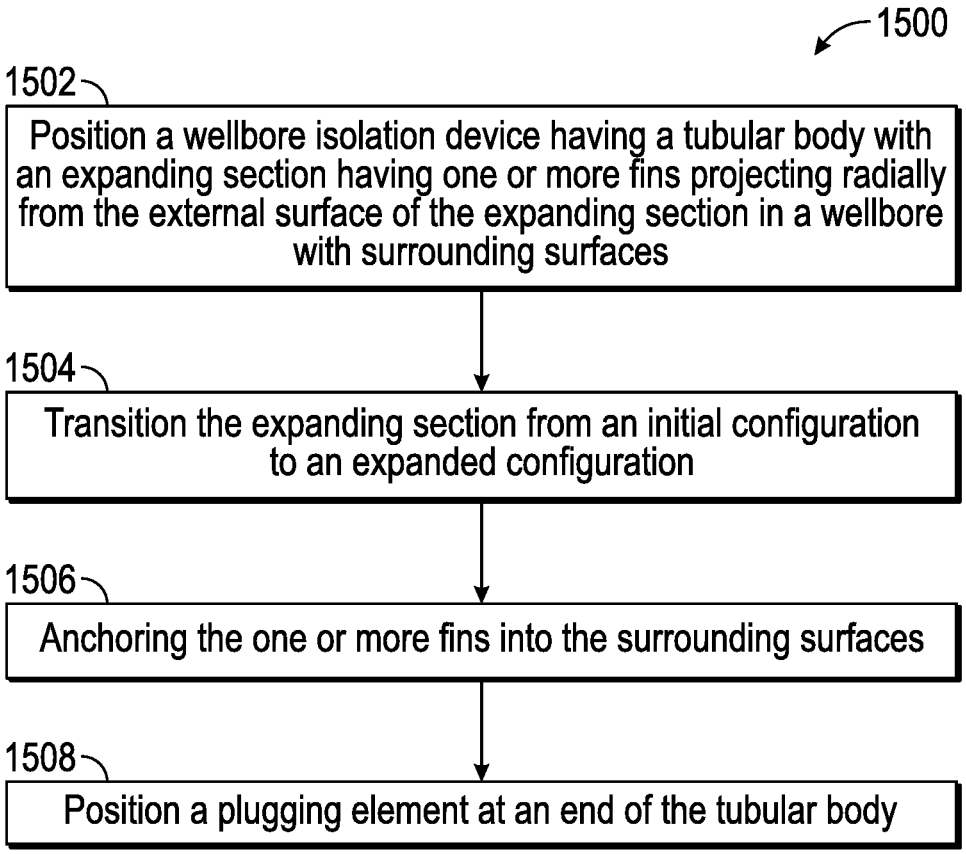
FIG. 15 is a flow chart of a method for utilizing a wellbore isolation device.

Referring to FIG. 15, a flowchart is presented in accordance with an example embodiment. The method 1500 is provided by way of example, as there are a variety of ways to carry out the method. The method 1500 described below can be carried out using the configurations illustrated in FIGS. 1-14, for example, and various elements of these figures are referenced in explaining example method 1500. Each block shown in FIG. 15 represents one or more processes, methods or subroutines, carried out in the example method 1500. Furthermore, the illustrated order of blocks is illustrative only and the order of the blocks can change according to the present disclosure. Additional blocks may be added or fewer blocks may be utilized, without departing from this disclosure. The example method 1500 can begin at block 1502.

At block 1502, a wellbore isolation device is positioned in a wellbore with surrounding surfaces. The wellbore isolation device has a tubular body with an expanding section. One or more fins project radially from the external surface of the expanding section. In at least one example, the one or more fins and the tubular body can be one single piece. In other examples, the one or more fins can be separate from the tubular body and coupled with the tubular body. For example, the fins can be split rings which are snapped onto the tubular body.

At block 1504, the expanding section transitions from an initial configuration where the external surface along the expanding section has an initial diameter to an expanded configuration where the external surface along the expanding section has an expanded diameter which is greater than the initial diameter.

The expanding section can transition from the initial configuration to the expanded configuration by the use of a downhole tool. The downhole tool includes an expansion cone which is positioned within the inner bore of the tubular body. The expansion cone can have an expansion portion which has an expansion diameter greater than the initial diameter of the expanding section. The expansion cone is then moved along an axial direction through the tubular body, deforming the expanding section by the expansion portion abutting against the expanding section.

At block 1506, the one or more fins are anchored into the surrounding surfaces. When the expanding section transitions to the expanded configuration, the fins anchor into the surrounding surfaces which can be, for example, casing, formation, or any other suitable surface. As such, the wellbore isolation device does not need any fitting elements to be positioned. The wellbore isolation device can be positioned any desired location within the wellbore to isolate zones. When the fins are anchored into the surrounding surfaces, a seal can be created such that fluid can substantially only pass through the inner bore of the wellbore isolation device.

At block 1508, a plugging element is positioned at an end of the tubular body to prevent fluid communication through the inner bore of the wellbore isolation device. As such, zones are isolated by the wellbore isolation device. In at least one example, the plugging element can be positioned at an end of the tubular body. In other examples, the plugging element can be positioned within the tubular body. The plugging element can be, for example, a ball, a valve, or any other suitable method or mechanism to prevent fluid communication through the inner bore.

Numerous examples are provided herein to enhance understanding of the present disclosure. A specific set of statements are provided as follows.

Statement 1: A wellbore isolation device comprising: a tubular body having an external surface and an inner bore formed longitudinally through the tubular body, the tubular body having an expanding section transitionable from an initial configuration wherein the external surface along the expanding section has an initial diameter to an expanded configuration wherein the external surface along the expanding section has an expanded diameter which is greater than the initial diameter; one or more fins projecting radially from the external surface of the expanding section, the one or more fins being anchorable into surrounding surfaces when the expanding section transitions to the expanded configuration; and a plugging element, the plugging element being positioned, after the expanding section is in the expanded configuration, to restrict fluid communication through the inner bore.

Statement 2: A wellbore isolation device is disclosed according to Statement 1, wherein the tubular body and the one or more fins are a single piece.

Statement 3: A wellbore isolation device is disclosed according to Statements 1 or 2, wherein the one or more fins are coupled with the tubular body.

Statement 4: A wellbore isolation device is disclosed according to Statement 3, wherein the one or more fins are split rings.

Statement 5: A wellbore isolation device is disclosed according to Statements 3 or 4, wherein the tubular body includes grooves operable to receive the one or more fins.

Statement 6: A wellbore isolation device is disclosed according to any of preceding Statements 1-5, wherein the one or more fins traverse substantially an entire circumference of the tubular body.

Statement 7: A wellbore isolation device is disclosed according to any of preceding Statements 1-6, further comprising: one or more sealing elements coupled with the expanding section of the tubular body, wherein the one or more sealing elements, when the expanding section transitions to the expanded configuration, the sealing elements abut the surrounding surfaces and create a seal such that fluid communication across the tubular body is at least reduced.

Statement 8: A wellbore isolation device is disclosed according to any of preceding Statements 1-8, wherein the one or more fins are made from a material selected from a group consisting of aluminum, steel, magnesium, cast iron, and a combination thereof.

Statement 9: A wellbore isolation device is disclosed according to any of preceding Statements 1-8, wherein the tubular body is made of a material that is degradable.

Statement 10: A wellbore isolation device is disclosed according to any of preceding Statements 1-9, wherein the tubular body is made of cast iron.

Statement 11: A wellbore isolation device is disclosed according to any of preceding Statements 1-10, wherein the plugging element is a ball.

Statement 12: A wellbore isolation device is disclosed according to any of preceding Statements 7-11, wherein the sealing element is made from a material selected from a group consisting of rubber, polymeric materials, ductile materials, polyurethane, elastomeric materials, degradable materials, and a combination thereof.

Statement 13: A wellbore isolation device is disclosed according to any of preceding Statements 1-12, wherein a material of the one or more fins and a material of the tubular body are different.

Statement 14: A wellbore isolation device is disclosed according to any of preceding Statements 1-13, wherein a material of the one or more fins and a material of the tubular body are the same.

Statement 15: A system comprising: a wellbore isolation device positioned in a wellbore by a conveyance, the wellbore isolation device including: a tubular body having an external surface and an inner bore formed longitudinally through the tubular body, the tubular body having an expanding section transitionable from an initial configuration wherein the external surface along the expanding section has an initial diameter to an expanded configuration wherein the external surface along the expanding section has an expanded diameter which is greater than the initial diameter; one or more fins projecting radially from the external surface of the expanding section, the one or more fins being anchorable into surrounding surfaces when the expanding section transitions to the expanded configuration; and a plugging element, the plugging element being positioned, after the expanding section is in the expanded configuration, to restrict fluid communication through the inner bore; and a downhole tool coupled with the conveyance, the downhole tool including: an expansion cone, the expansion cone being positioned within the inner bore of the tubular body, the expansion cone having an expansion portion which has an expansion diameter greater than the initial diameter of the expanding section, wherein when the expansion cone is moved along an axial direction through the tubular body, the expansion cone transitions the expanding section from the initial configuration to the expanded configuration.

Statement 16: A system is disclosed according to Statement 15, wherein the expansion cone includes an expansion portion with an expansion diameter, and wherein when the expansion cone transitions the expanding section from the initial configuration to the expanded configuration, the expansion diameter of the expansion cone abuts and expands the expanding section from the initial configuration to the expanded configuration.

Statement 17: A system is disclosed according to Statements 15 or 16, wherein the tubular body and the one or more fins are a single piece.

Statement 18: A system is disclosed according to any of preceding Statements 15-17, wherein the one or more fins are coupled with the tubular body.

Statement 19: A system is disclosed according to Statement 18, wherein the one or more fins are split rings.

Statement 20: A system is disclosed according to Statements 18 or 19, wherein the tubular body includes grooves operable to receive the one or more fins.

Statement 21: A system is disclosed according to any of preceding Statements 15-20, wherein the one or more fins traverse substantially an entire circumference of the tubular body.

Statement 22: A system is disclosed according to any of preceding Statements 15-21, further comprising: one or more sealing elements coupled with the expanding section of the tubular body, wherein the one or more sealing elements, when the expanding section transitions to the expanded configuration, the sealing elements abut the surrounding surfaces and create a seal such that fluid communication across the tubular body is at least reduced.

Statement 23: A system is disclosed according to any of preceding Statements 15-22, wherein the surrounding surfaces is a casing.

Statement 24: A system is disclosed according to any of preceding Statements 15-23, wherein the one or more fins are made from a material selected from a group consisting of aluminum, steel, magnesium, cast iron, and a combination thereof.

Statement 25: A system is disclosed according to any of preceding Statements 15-24, wherein the tubular body is made of a material that is degradable.

Statement 26: A system is disclosed according to any of preceding Statements 15-25, wherein the tubular body is made of cast iron.

Statement 27: A system is disclosed according to any of preceding Statements 15-26, wherein the plugging element is a ball.

Statement 28: A system is disclosed according to any of preceding Statements 22-27, wherein the sealing element is made from a material selected from a group consisting of rubber, polymeric materials, ductile materials, polyurethane, elastomeric materials, degradable materials, and a combination thereof.

Statement 29: A system is disclosed according to any of preceding Statements 15-28, wherein a material of the one or more fins and a material of the tubular body are different.

Statement 30: A system is disclosed according to any of preceding Statements 15-29, wherein a material of the one or more fins and a material of the tubular body are the same.

Statement 31: A method to isolate a portion of a wellbore, the method comprising: positioning, by a conveyance, a wellbore isolation device in a wellbore with surrounding surfaces, the wellbore isolation device including: a tubular body having an external surface and an inner bore formed longitudinally through the tubular body, the tubular body including an expanding section; one or more fins radially projecting from the external surface of the expanding section; transitioning the expanding section from an initial configuration wherein the external surface along the expanding section has an initial diameter to an expanded configuration wherein the external surface along the expanding section has an expanded diameter which is greater than the initial diameter; anchoring the one or more fins into the surrounding surfaces; positioning, after the expanding section is in the expanded configuration, a plugging element to restrict fluid communication through the inner bore.

Statement 32: A method is disclosed according to Statement 31, wherein transitioning the expanding section further comprises: providing a downhole tool with an expansion cone, the expansion cone being positioned within the inner bore of the tubular body, the expansion cone having an expansion portion which has an expansion diameter greater than the initial diameter of the expanding section; moving an expansion cone along an axial direction through the tubular body; deforming the expanding section by the expansion portion abutting against the expanding section.

Statement 33: A method is disclosed according to Statements 31 or 32, wherein the wellbore isolation device further includes one or more sealing elements coupled with the expanding section of the tubular body, wherein creating a seal further comprises: abutting the surrounding surfaces with the sealing elements.

Statement 34: A method is disclosed according to any of preceding Statements 31-33, wherein the one or more fins traverse substantially an entire circumference of the tubular body.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A wellbore isolation device comprising:

a tubular body having an external surface and an inner bore formed longitudinally through the tubular body, the tubular body having an expanding section transitionable from an initial configuration, wherein the external surface along the expanding section has an initial diameter to an expanded configuration, wherein the external surface along the expanding section has an expanded diameter which is greater than the initial diameter, wherein when the expanding section transitions from the initial configuration to the expanded configuration the tubular body deforms and maintains the expanded configuration;

a plurality of fins projecting radially from the external surface of the expanding section, the fins being anchorable into surrounding surfaces when the expanding section transitions to the expanded configuration;

a plurality of sealing elements coupled with the expanding section of the tubular body, wherein the sealing elements, when the expanding section transitions to the expanded configuration, the sealing elements abut the surrounding surfaces and create a seal such that fluid communication across the tubular body is at least reduced, wherein two sealing elements of the plurality of sealing elements are positioned on adjacent sides of a central fin of the plurality of fins; and a plugging element, the plugging element being positioned, after the expanding section is in the expanded configuration, to restrict fluid communication through the inner bore.

2. The wellbore isolation device of claim 1, wherein the tubular body and the fins are a single piece.

3. The wellbore isolation device of claim 1, wherein the fins are coupled with the tubular body.

4. The wellbore isolation device of claim 3, wherein the fins are split rings.

5. The wellbore isolation device of claim 3, wherein the tubular body includes grooves operable to receive the fins.

6. The wellbore isolation device of claim 1, wherein the fins traverse substantially an entire circumference of the tubular body.

7. The wellbore isolation device of claim 1, wherein the sealing elements extend from the tubular body further than the fins such that when the expanding section transitions to the expanded configuration, the sealing elements abut the surrounding surfaces, compress, and provide a seal.

8. The wellbore isolation device of claim 1, wherein each of the sealing elements are positioned between corresponding fins.

9. A system comprising:

a wellbore isolation device positioned in a wellbore by a conveyance, the wellbore isolation device including:

a tubular body having an external surface and an inner bore formed longitudinally through the tubular body, the tubular body having an expanding section transitionable from an initial configuration wherein the external surface along the expanding section has an initial diameter to an expanded configuration wherein the external surface along the expanding section has an expanded diameter which is greater than the initial diameter;

a plurality of fins projecting radially from the external surface of the expanding section, the fins being anchorable into surrounding surfaces when the expanding section transitions to the expanded configuration;

a plurality of sealing elements coupled with the expanding section of the tubular body, wherein the sealing elements, when the expanding section transitions to the expanded configuration, the sealing elements abut the surrounding surfaces and create a seal such that fluid communication across the tubular body is at least reduced, wherein two sealing elements of the plurality of sealing elements are positioned on adjacent sides of a central fin of the plurality of fins; and a plugging element, the plugging element being positioned, after the expanding section is in the expanded configuration, to restrict fluid communication through the inner bore; and a downhole tool coupled with the conveyance, the downhole tool including:

an expansion cone, the expansion cone being positioned within the inner bore of the tubular body, the expansion cone having an expansion portion which has an expansion diameter greater than the initial diameter of the expanding section, wherein when the expansion cone is moved along an axial direction through the tubular body, the expansion cone transitions the expanding section from the initial configuration to the expanded configuration, wherein when the expanding section transitions from the initial configuration to the expanded configuration the tubular body deforms and maintains the expanded configuration.

10. The system of claim 9, wherein the expansion cone includes an expansion portion with an expansion diameter, and wherein when the expansion cone transitions the expanding section from the initial configuration to the expanded configuration, the expansion diameter of the expansion cone abuts and expands the expanding section from the initial configuration to the expanded configuration.

11. The system of claim 9, wherein the tubular body and the fins are a single piece.

12. The system of claim 9, wherein the fins are coupled with the tubular body.

13. The system of claim 12, wherein the fins are split rings.

14. The system of claim 12, wherein the tubular body includes grooves operable to receive the fins.

15. The system of claim 9, wherein the fins traverse substantially an entire circumference of the tubular body.

16. The system of claim 9, wherein the surrounding surfaces is a casing.

17. The system of claim 9, wherein the sealing elements extend from the tubular body further than the fins such that when the expanding section transitions to the expanded configuration, the sealing elements abut the surrounding surfaces, compress, and provide a seal.

18. The system of claim 9, wherein each of the sealing elements are positioned between corresponding fins.

19. A method to isolate a portion of a wellbore, the method comprising:

positioning, by a conveyance, a wellbore isolation device in a wellbore with surrounding surfaces, the wellbore isolation device including:

a tubular body having an external surface and an inner bore formed longitudinally through the tubular body, the tubular body including an expanding section;

a plurality of fins radially projecting from the external surface of the expanding section;

a plurality of sealing elements coupled with the expanding section of the tubular body, wherein two sealing elements of the plurality of sealing elements are positioned on adjacent sides of a central fin of the plurality of fins;

transitioning the expanding section from an initial configuration wherein the external surface along the expanding section has an initial diameter to an expanded configuration wherein the external surface along the expanding section has an expanded diameter which is greater than the initial diameter, wherein when the expanding section transitions from the initial configuration to the expanded configuration the tubular body deforms and maintains the expanded configuration;

abutting the surrounding surfaces with the sealing elements anchoring the fins into the surrounding surfaces;

positioning, after the expanding section is in the expanded configuration, a plugging element to restrict fluid communication through the inner bore.

20. The method of claim 19, wherein transitioning the expanding section further comprises:

providing a downhole tool with an expansion cone, the expansion cone being positioned within the inner bore of the tubular body, the expansion cone having an expansion portion which has an expansion diameter greater than the initial diameter of the expanding section;

moving an expansion cone along an axial direction through the tubular body;

deforming the expanding section by the expansion portion abutting against the expanding section.

21. The method of claim 19, wherein the fins traverse substantially an entire circumference of the tubular body.

22. The method of claim 19, wherein the sealing elements extend from the tubular body further than the fins such that when the expanding section transitions to the expanded configuration, the sealing elements abut the surrounding surfaces, compress, and provide a seal.

23. The method of claim 19, wherein each of the sealing elements are positioned between corresponding fins.

* * * * *